United States Patent [19]

Brim

[11] Patent Number: 4,834,379

[45] Date of Patent: May 30, 1989

[54] METHOD OF PLAYING A BOWLING GAME

[75] Inventor: Ted E. Brim, Grand Haven, Mich.

[73] Assignee: Brunswick Corporation, Skokie, Ill.

[21] Appl. No.: 118,243

[22] Filed: Nov. 9, 1987

[51] Int. Cl.[4] ..... A63D 5/00
[52] U.S. Cl. ..... 273/37
[58] Field of Search ..... 273/37, 54 C, 54 R, 273/54 D

[56] References Cited

U.S. PATENT DOCUMENTS 3,212,780 10/1965 Jewell ..... 273/54 C
3,529,824 9/1970 Walch ..... 273/54 R
4,597,575 7/1986 Kosof ..... 273/37

FOREIGN PATENT DOCUMENTS 809541 4/1969 Canada ..... 273/54 C

OTHER PUBLICATIONS

First Stage Market Test of Brunswick's New Bowling System—Final Report Apr. 1986.

*Primary Examiner*—Anton O. Oechsle
*Attorney, Agent, or Firm*—Wood, Dalton, Phillips Mason & Rowe

[57] ABSTRACT

A method of playing a bowling game in which players are allowed a preselected plurality of balls to knock down as many pins as possible in each of a plurality of pin setups. Each player is required to deliver at least one of the preselected plurality of balls and continuing to deliver balls until all the pins in each full pin setup are knocked down. The number of balls delivered by each player and the number of pins knocked down in the respective pin setup are counted, to determine a score for each player for each pin setup. Each player's setup score is recorded as determined by that counting. Each player's setup scores are added to determine that player's total score for the game. The players' game scores are compared to determine the winner of the game.

6 Claims, 1 Drawing Sheet

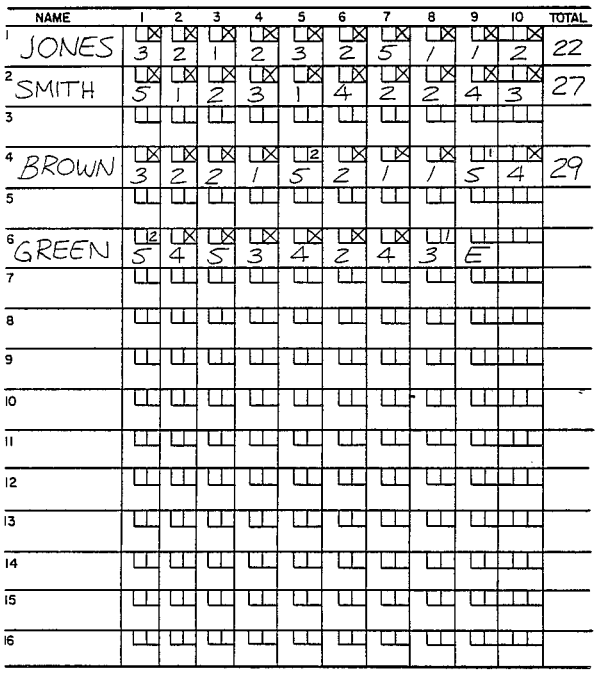

| NAME | 1 | 2 | 3 | 4 | 5 | 6 | 7 | 8 | 9 | 10 | TOTAL |
|---|---|---|---|---|---|---|---|---|---|---|---|
| 1 JONES | 3 | 2 | 1 | 2 | 3 | 2 | 5 | 1 | 1 | 2 | 22 |
| 2 SMITH | 5 | 1 | 2 | 3 | 1 | 4 | 2 | 2 | 4 | 3 | 27 |
| 3 | | | | | | | | | | | |
| 4 BROWN | 3 | 2 | 2 | 1 | 5 | 2 | 1 | 1 | 5 | 4 | 29 |
| 5 | | | | | | | | | | | |
| 6 GREEN | 5 | 4 | 5 | 3 | 4 | 2 | 4 | 3 | E | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

| NAME | 1 | 2 | 3 | 4 | 5 | 6 | 7 | 8 | 9 | 10 | TOTAL |
|---|---|---|---|---|---|---|---|---|---|---|---|
| 1 JONES | 3 | 2 | 1 | 2 | 3 | 2 | 5 | 1 | 1 | 2 | 22 |
| 2 SMITH | 5 | 1 | 2 | 3 | 1 | 4 | 2 | 2 | 4 | 3 | 27 |
| 3 | | | | | | | | | | | |
| 4 BROWN | 3 | 2 | 2 | 1 | 5 | 2 | 1 | 1 | 5 | 4 | 29 |
| 5 | | | | | | | | | | | |
| 6 GREEN | 5 | 4 | 5 | 3 | 4 | 2 | 4 | 3 | E | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

METHOD OF PLAYING A BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. For many recreational or ordinary players, it is difficult to learn and understand the play of the game. This is because, in part, conventional bowling games require a strike or a spare to add a pin count for pins knocked down in subsequent frames to the pin counts in earlier frames. Quite often, running scores near the end of a game are not entered until the very last ball of a player is delivered. This cumbersome and difficult method of playing a conventional bowling game often leads to frustration and lack of interest to everyone but the skilled player. It is not uncommon for players to simply roll balls at pins and leave the scoring to others and never completely understand the rules of play. This leads to a lack of real interest and ultimately to players giving up on the sport.

In addition, conventional methods of playing bowling games often do not give a true indication of a player's skill. Leads shift back and forth during a game depending solely on sequences of strikes and spares, particularly near the end of a game. One player can build up such an early lead, again depending on his play timing, that other players lose hope and interest, and the level of play is greatly diminished.

There is a defininte need for new methods of playing a bowling game which are easier to understand and learn and, accordingly, to play; for games which are more exciting during the entire play of the game; for games which are challenging but not difficult; and for games to increase and enhance the public interest in the sport. This invention is directed to satisfying these needs and to rectifying problems inherent in the conventional method of playing a bowling game.

SUMMARY OF THE INVENTION

An object of the invention, therefore, is to provide a new method of playing a bowling game.

Another object of the invention is to provide a new method of playing a bowling game in which players are allowed a preselected plurality of balls to knock down as many pins as possible in each of a plurality of full pin setups.

The method includes the steps of requiring each player to deliver at least one of the preselected plurality of balls and continuing to deliver balls until all the pins in each full pin setup are knocked down. The number of balls delivered by each player and the number of pins knocked down in the respective pin setup are counted, to determine a score for each player for each pin setup. Each player's setup score is recorded as determined by the counting. Each player's setup scores are added to determine that player's total score for the game. The players' game scores are compared to determine the winner of the game.

Each player may be limited to a given maximum number of balls allowed to be delivered in any given pin setup. In such a scheme of play, the pin setup score is calculated to include the number of pins remaining in a given pin setup after all the maximum number of balls have been delivered by a player for that pin setup.

The scheme of play may include limiting each player to a given maximum number of balls to be delivered in the game. In such play, any player is eliminated from the game when he has delivered all of the maximum number of balls.

Other objects, features and advantages of the invention will be apparent from the following detailed description taken in connection with the accompanying drawing.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawing showing a simulated score sheet which might be used in playing the bowling game of this invention.

DETAILED DESCRIPTION OF THE PREFERRED EMBODIMENT

The invention contemplates a rather unique method of playing a bowling game wherein each player of the game is allowed a preselected plurality of balls to knock down as many pins as possible in each of a plurality of full pin setups, a "full" pin setup meaning a full ten-pin frame as encountered in a conventional bowling game. In addition, each player can be limited to a given maximum number of balls allowed to be delivered in any given pin setup or frame. This would affect the scoring as described below. Furthermore, a player might be limited to a given maximum number of balls to be delivered in the entire game. For instance, in a game which might include ten separate full pin setups of ten pins each, a player might be limited to a maximum number of five balls allowed to be delivered in any given pin setup. The player also or alternatively might be limited to fifty, more or less, balls which the player is allowed to deliver during an entire game.

Generally, the method of playing a bowling game as described above includes the steps of requiring each player to deliver at least one of the preselected plurality of balls and continuing to deliver balls until all the pins in each full pin setup are knocked down. The players may rotate in turns or a single player may deliver his total game balls at an entire series of pin setups before the next player takes his turn. This would depend upon the original scheme of the game.

The number of balls delivered by each player and the number of pins knocked down in a respective pin setup then are counted, to determine a score for each player for each pin setup. Each player's setup score is recorded determined by that counting. Each player's setup scores are added to determine that player's total score for the game. The players' game scores then are compared to determine the winner of the game.

Turning to the drawing, assume that a twosome of Jones and Smith are playing a bowling game according to the method of this invention. A standard score sheet as might be used in a conventional bowling game can be used, as shown. It can be seen that ten columns are used to indicate "frames" or pin setups as in the method of this invention. Each pin setup has a given number of pins, such as a "full" pin setup of ten pins each.

Generally, as stated above, each player is allowed a preselected plurality of balls to knock down as many pins as possible in each of the ten pin setups. Each player then is required to deliver at least one of the preselected plurality of balls and continues to deliver the balls until all the pins in each pin setup are knocked down.

In addition, the game can include limiting the number of balls allowed to be delivered in any given pin setup to a given maximum. Each player also can be limited to a given maximum number of balls allowed to be delivered during the entire game. For purposes of illustration and further depiction on the score sheet in the drawing, assume that each player, Jones and Smith, are limited to five balls allowed to be delivered in any given pin setup and thirty balls allowed to be delivered during the entire game.

In pin setup or frame "1", Jones delivers three balls in pin setup "1" to knock down all ten pins. The number "3" is inserted in Jones' score box for pin setup "1" to indicate the number of balls for Jones to "clear the deck", along with a "X" in his small score box indicating all pins were knocked down. Smith needed five balls to knock down all ten pins in pin setup "1" and the setup score of "5" is recorded in Smith's box score position.

In pin setup or frame "2", Jones needed two balls to knock down all ten pins and, therefore, a score of "2" is recorded in his box score. Smith scored a "strike" by knocking down all ten pins with a single ball and, therefore, the number "1" is inserted in Smith's box score. The running game score after two pin setups is Jones leading the game "5" to "6", notwithstanding Smith's strike, because Jones needed lesser balls to knock down all of the pins in the first two pin setups than the number of balls required by Smith. The delivering of balls, in turn, for each of the remaining pin setups is continued by Jones and Smith throughout the game, with the number of balls delivered and the number of pins knocked down in each respective pin setup determining the score for each of the players. At the end of the game, it can be seen that Jones used only twenty-two balls to "clear the deck" in all ten pin setup frames, whereas Smith used twenty-seven balls. Therefore, Jones won the game. Neither Jones nor Smith needed more than their maximum number of frame balls or maximum number of game balls.

To illustrate the play of the game and the effect of each player being limited to a given maximum number of balls allowed to be delivered in any given pin setup, reference is made back to the drawing. Assume Brown also was playing the game and his scores are recorded as shown. It can be seen that Brown had a rather erratic game, recording three strikes but failing to knock down all of the ten pins in two different pin setups, i.e. pin setups "5" and "9". He left two pins standing in setup "5", and one pin was left standing in setup "9". These "leaves" are added to Brown's score, resulting in a total game score of "29" which is a worse score than Smith even though Brown delivered one less ball (i.e. Brown delivered 26 balls versus Smith's 27 balls.

Still further, assume that Green also was playing the game, but the method included limiting each player to a given maximum number of balls allowed to be delivered in the games, such as thirty balls. It can be seen that Green had a difficult game, using five balls in pin setup "1" and leaving two pins. His setup score for that "frame" is shown as "7". Green required four balls in pin setup "2" to knock down all ten pins, five balls to knock down all pins in setup "3", three balls to knock down all pins in setup "4", and so on until pin setup "8" whereupon Green ran out of all of his thirty balls and still left one pin standing. At that point, Green is eliminated as indicated by the indicia "E".

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of playing a bowling game in which players are allowed a plurality of balls to knock down all of the pins in each of a plurality of full pin setups, said method comprising:
   (a) requiring each player to deliver at least one of said preselected plurality of balls and continuing to deliver balls until all the pins in each full pin setup are knocked down;
   (b) counting the number of balls delivered by each player to determine a score for each player for each pin setup;
   (c) recording each player's setup score determined by said counting;
   (d) adding each player's setup scores to determine said player's total score for the game; and
   (e) comparing the players' game scores to determine the winner of the game.

2. The method of claim 1 wherein each player is limited to a given maximum number of balls allowed to be delivered in the game.

3. The method of claim 2 wherein any player is eliminated from the game when he has delivered all of said maximum number of balls.

4. A method of playing a bowling game in which players are allowed a plurality of balls to knock down all of the pins in each of a plurality of pin setups, said method comprising:
   (a) requiring each player to deliver at least one of said preselected plurality of balls and continuing to deliver balls until all the pins in each pin setup are knocked down or until a given maximum number of balls have been delivered;
   (b) counting the number of balls delivered by each player to determine a score for each player for each pin setup;
   (c) recording each player's setup score determined by said counting;
   (d) adding each player's setup scores to determine said player's total score for the game; and
   (e) comparing the players' game scores to determine the winner of the game.

5. The method of claim 4 wherein each player is limited to a given maximum number of balls allowed to be delivered in the game.

6. The method of claim 5 wherein any player is eliminated from the game when he has delivered all of said maximum number of balls.

* * * * *